US010622174B2

(12) United States Patent
Mizrahi et al.

(10) Patent No.: US 10,622,174 B2
(45) Date of Patent: Apr. 14, 2020

(54) TOGGLE-TYPE SWITCH FOR PORTABLE COMMUNICATIONS DEVICE

(71) Applicant: MOTOROLA SOLUTIONS, INC., Chicago, IL (US)

(72) Inventors: Yossi Mizrahi, Rishon-Letzion (IL); Ehud Elraz, Beit Hashmonai (IL); Ariel Rotman, Ramat Efal (IL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 15/923,721

(22) Filed: Mar. 16, 2018

(65) Prior Publication Data

US 2019/0287745 A1 Sep. 19, 2019

(51) Int. Cl.

*H01H 23/08* (2006.01)
*H01H 23/28* (2006.01)
*H01H 23/00* (2006.01)

(52) U.S. Cl.

CPC ..... *H01H 23/08* (2013.01); *H01H 23/006* (2013.01); *H01H 23/28* (2013.01); *H01H 2203/026* (2013.01)

(58) Field of Classification Search

CPC .... H01H 13/705; H01H 25/041; H01H 13/70; H01H 2025/048; H01H 2209/006; H01H 2217/012; H01H 2221/012; H01H 2225/018; H01H 2300/01; H01H 23/003; H01H 13/00; H01H 13/785; H01H 13/807; H01H 13/84; H01H 2003/0293; H01H 2009/187; H01H 2025/045; H01H 21/22; H01H 2201/02; H01H 2201/036; H01H 2209/002; H01H 2209/01; H01H 2209/016; H01H 2209/07; H01H 2209/082; H01H 2213/008; H01H 2215/004; H01H 2217/004; H01H 2217/01; H01H 2217/016; H01H 2219/028; H01H 2221/002; H01H 2221/006; H01H 2221/016; H01H 2221/024; H01H 2221/05; H01H 2221/058; H01H 2221/07; H01H 2221/078;

(Continued)

(56) References Cited

U.S. PATENT DOCUMENTS 4,191,387 A 3/1980 Kirchoff
6,239,392 B1 * 5/2001 Serizawa ..... H01H 23/003 200/1 B (Continued)

*Primary Examiner* — Ahmed M Saeed
(74) *Attorney, Agent, or Firm* — Michael Best & Friedrich LLP

(57) ABSTRACT

A toggle-type switch for a portable communications device includes a circuit board to be positioned within a cavity of a portable communications device. In one instance, the circuit board includes a first flank, a second flank disposed opposite the first flank, and a central rib disposed between the first and the second flanks. The circuit board has a non-planar shape, such that the first flank and the second flank are each offset relative to the central rib. The toggle-type switch includes a first electrical contact element coupled to the first flank, a second electrical contact element coupled to the second flank, and a projecting lever located above the central rib and between the first flank and the second flank. The projecting lever has a first leg to engage the first electrical contact element and a second leg to engage the second electrical contact element.

19 Claims, 10 Drawing Sheets

(58) Field of Classification Search
CPC ..... H01H 2223/0345; H01H 2225/01; H01H 2225/03; H01H 2227/002; H01H 2229/048; H01H 2231/018; H01H 2233/072; H01H 2233/078; H01H 2239/006; H01H 2239/03; H01H 2239/052; H01H 23/145; H01H 23/30; H01H 25/008
See application file for complete search history.

(56) References Cited

U.S. PATENT DOCUMENTS

| | | | | |
|---|---|---|---|---|
| 6,857,357 | B2 | 2/2005 | Fujii | |
| 2009/0301857 | A1* | 12/2009 | Hamel | H01H 23/145 200/523 |

* cited by examiner

TOGGLE-TYPE SWITCH FOR PORTABLE COMMUNICATIONS DEVICE

BACKGROUND OF THE INVENTION

Toggle-type switches are often used in portable communications devices, for example in portable radios, cellular telephones, and other devices. The toggle-type switches are located, for example, on the sides or along the tops of the devices, and are used for example to switch between menu commands, to control volume settings, or to otherwise allow users to change or adjust features on the devices.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate various embodiments, and explain various principles and advantages of those embodiments.

Figure 1:
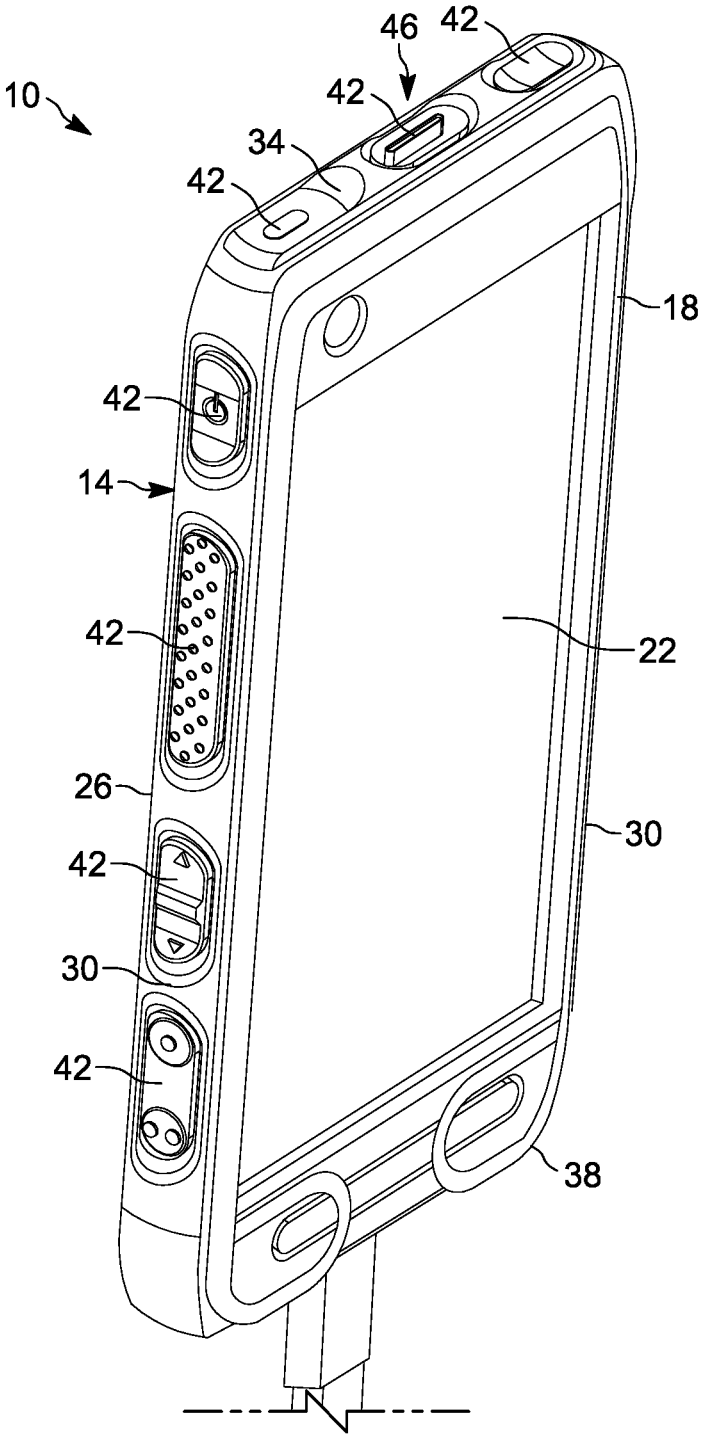
FIG. 1 illustrates a portable communications device in accordance with one embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments.

The apparatus and method components have been represented where appropriate by conventional symbols in the drawings, showing only those specific details that are pertinent to understanding the embodiments so as not to obscure the disclosure with details that will be readily apparent to those of ordinary skill in the art having the benefit of the description herein.

DETAILED DESCRIPTION OF THE INVENTION

As noted above, toggle-type switches are useful and used in a variety of electronic devices. However, most current toggle-type switches are relatively large. As a consequence, use of these switches requires the devices to have a large thickness to accommodate toggle-type switches. Accordingly, there is a need for an improved toggle-type switch that is smaller in size than many currently-available switches. A reduced-size switch would allow for devices with reduced thickness and provide more space for, for example, antennas and connector ports (for example, a USB port).

One embodiment provides a toggle-type switch for a portable communications device. In one example, the toggle-type switch includes a circuit board configured to be positioned within a cavity defined by a housing of a portable communications device. The circuit board includes a first flank, a second flank disposed opposite the first flank, and a central rib disposed between the first flank and the second flank. The circuit board has a non-planar shape, such that the first flank of the circuit board and the second flank of the circuit board are each offset relative to the central rib of the circuit board. The toggle-type switch further includes a first electrical contact element coupled to the first flank, a second electrical contact element coupled to the second flank, and a projecting lever located above the central rib and between the first flank and the second flank. The projecting lever has a first leg configured to engage the first electrical contact element and a second leg configured to engage the second electrical contact element.

Another embodiment provides a portable communications device. In one example, the portable communications device includes a housing having a front portion, a rear portion disposed opposite the front portion, and a side portion that extends between the front portion and the rear portion. The side portion includes a cavity. The portable communications device also includes a toggle-type switch having a circuit board positioned within the cavity. The circuit board includes a first flank, a second flank disposed opposite the first flank, and a central rib disposed between the first flank and the second flank. The circuit board also has a non-planar shape, such that the first flank of the circuit board and the second flank of the circuit board are each offset relative to the central rib of the circuit board. The toggle-type switch further includes a first electrical contact element coupled to the first flank, a second electrical contact element coupled to the second flank, and a projecting lever located above the central rib and between the first flank and the second flank. The projecting lever has a first leg configured to engage the first electrical contact element and a second leg configured to engage the second electrical contact element.

Another embodiment provides a portable communications device. In one example, the portable communications device includes a housing, and a flexible circuit board coupled to the housing. The flexible circuit board has a non-linear cross-sectional profile. The portable communications device further includes a projecting lever operatively coupled to the housing and the flexible circuit board, a first electrical contact element coupled to an inner surface of the flexible circuit board, and a second electrical contact element coupled to the inner surface of the flexible circuit board, wherein the first and second electrical contact elements generally face each other. The projecting lever pivots between the first electrical contact element and the second electrical contact element to perform a switch operation.

FIGS. 1-8 illustrate a portable communications device 10. While the illustrated portable communications device 10 is a portable, handheld two-way radio, the portable communications device 10 may be a smart telephone, tablet computer, or other type of portable communications device.

With reference to FIG. 1, the portable communications device 10 includes a housing 14. In the illustrated embodiment, the housing 14 is an outer casing (for example, made of plastic or other rigid material) for the portable communications device 10. The housing 14 includes a front portion 18 that includes a display 22, for example, a touch screen. The housing 14 also includes a rear portion 26 disposed opposite the front portion 18 and side portions 30 that extend between the front portion 18 and the rear portion 26 along sides of the portable communications device 10. The housing also includes a top portion 34 that extends between the front portion 18 and the rear portion 26 along a top of the portable communications device 10, and a bottom portion 38 that extends between the front portion 18 and the rear portion 26 along a bottom of the portable communications device 10. Other embodiments of the housing 14 may be shaped and sized differently than the illustrated example.

The portable communications device 10 includes various user controls 42 (for example, press-buttons, toggle-type switches, or other control features) for controlling volume, changing channels, controlling power, controlling menu selection on the display 22, and the like disposed along one or more of the side portions 30 and along the top portion 34. In the illustrated embodiment, one of the controls 42 is a toggle-type switch 46 (the term "toggle-type switch" may include for example a toggle switch assembly or a switch assembly) disposed along the top portion 34 of the portable communications device 10. In some embodiments, the portable communications device 10 may include more than one toggle-type switch 46, and/or may include a toggle-type switch or switches disposed along one of the side portions 30 or along the bottom portion 38.

With reference to FIGS. 2-7, the toggle-type switch 46 includes a flexible circuit board 50 having a first flank 54 (for example, an arm or wing), a second flank 58 (for example, an arm or wing) disposed opposite the first flank 54, and a central rib 62 (for example, a main body or central body) disposed between and connecting the first flank 54 to the second flank 58. In the example shown, the first flank 54, the second flank 58, and the central rib 62 each have a rectangular or substantially rectangular shape. In other embodiments, the first and second flanks 54, 58 and the central rib 62 may have different sizes and shapes than those illustrated.

Additionally, in the example provided, the first and second flanks 54, 58 are of identical size and shape, such that the circuit board 50 is symmetrical about the central rib 62. In other embodiments, the first flank 54 may have a different size and/or shape than the second flank 58 and the configuration may be asymmetric. In one example, the circuit board 50 has a C-shaped cross-sectional profile.

Figure 2:
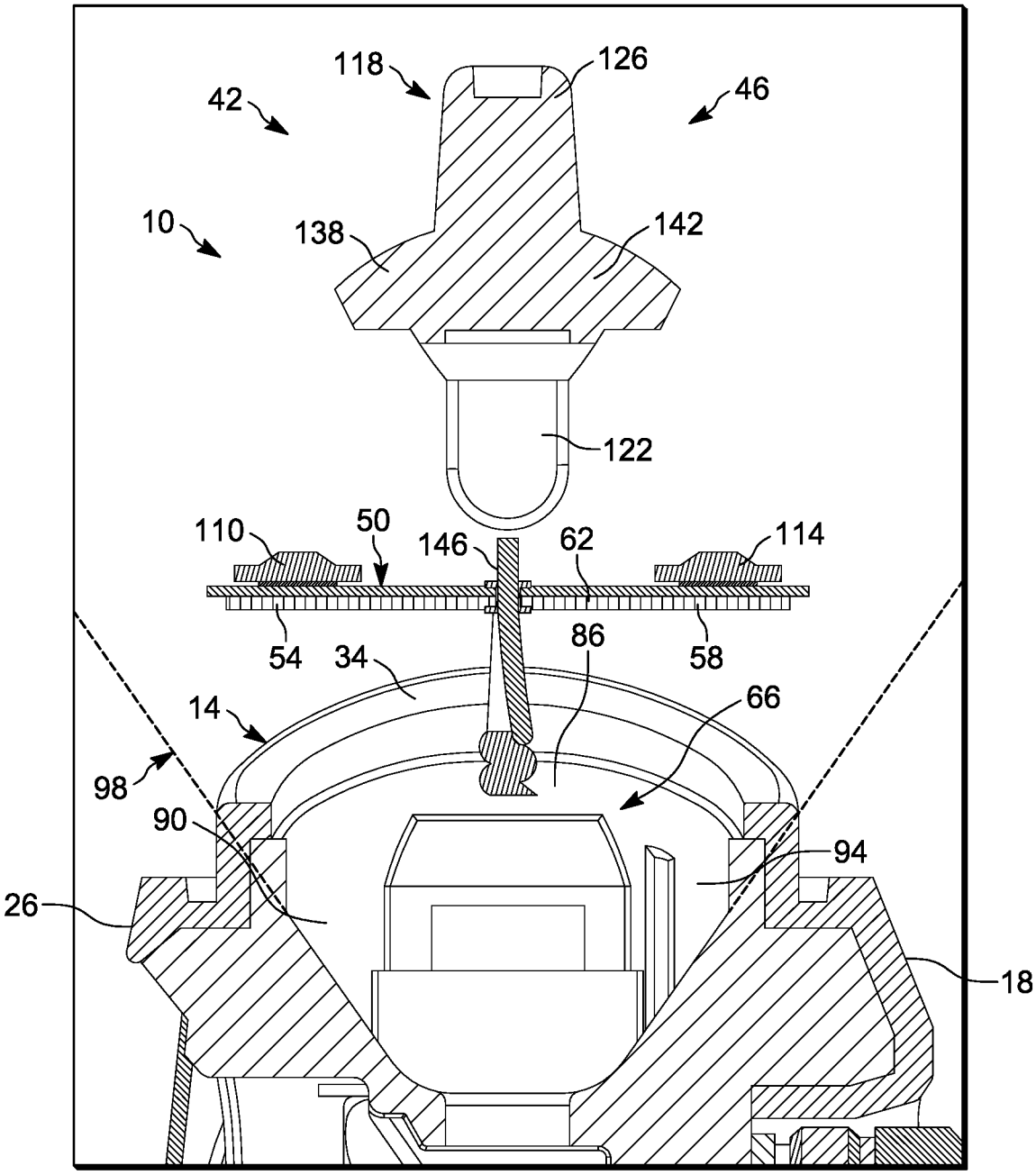
FIG. 2 illustrates a toggle-type switch of the portable communications device of FIG. 1, in an unassembled state.
Figure 3A:
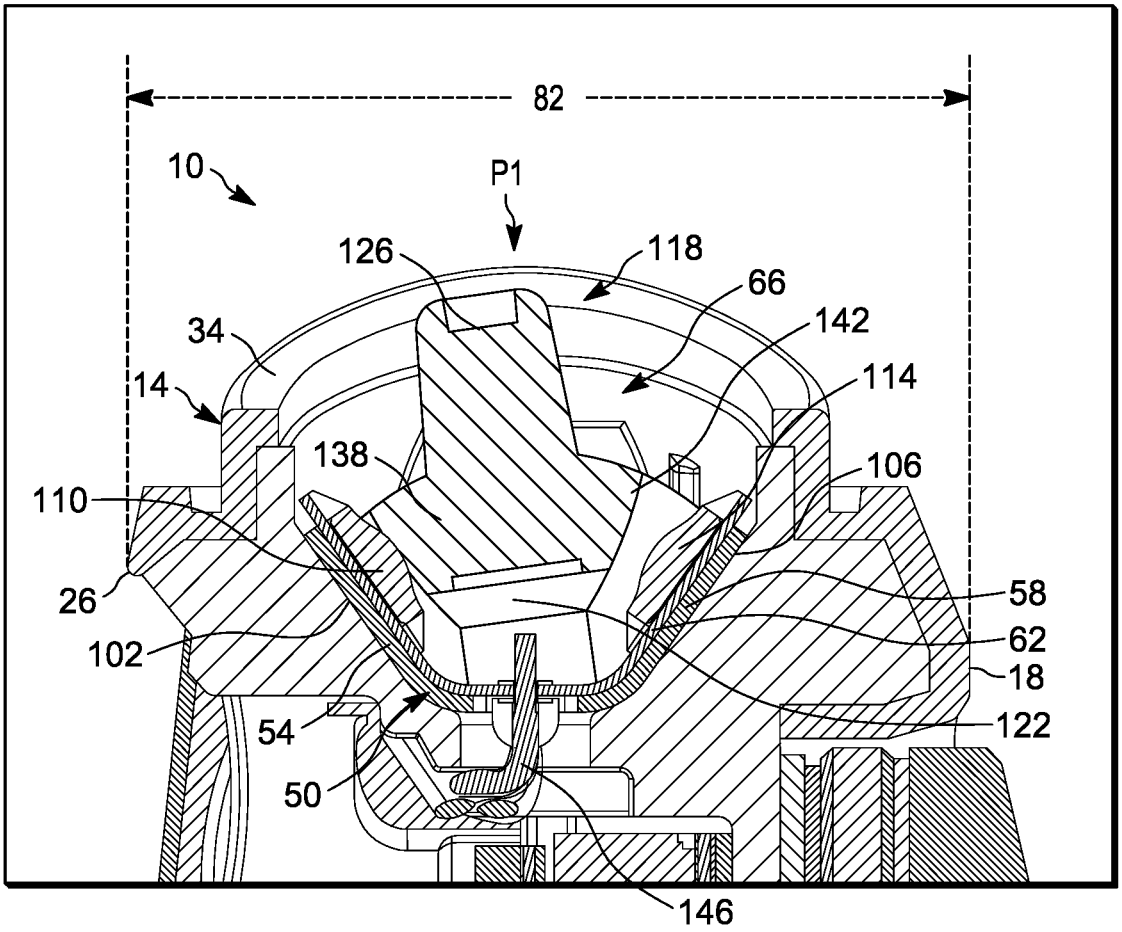
FIGS. 3A-3C illustrate the toggle-type switch in an assembled state.
Figure 3B:
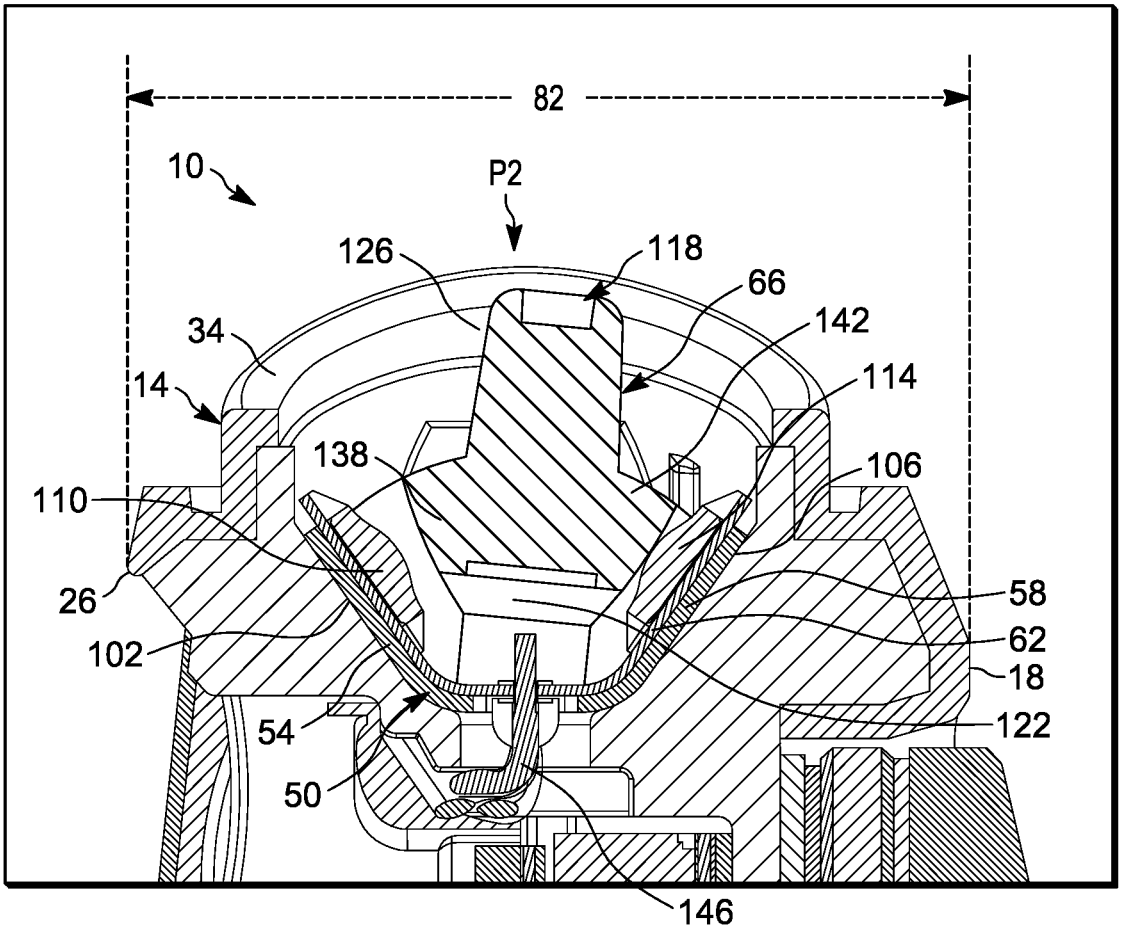
Figure 3C:
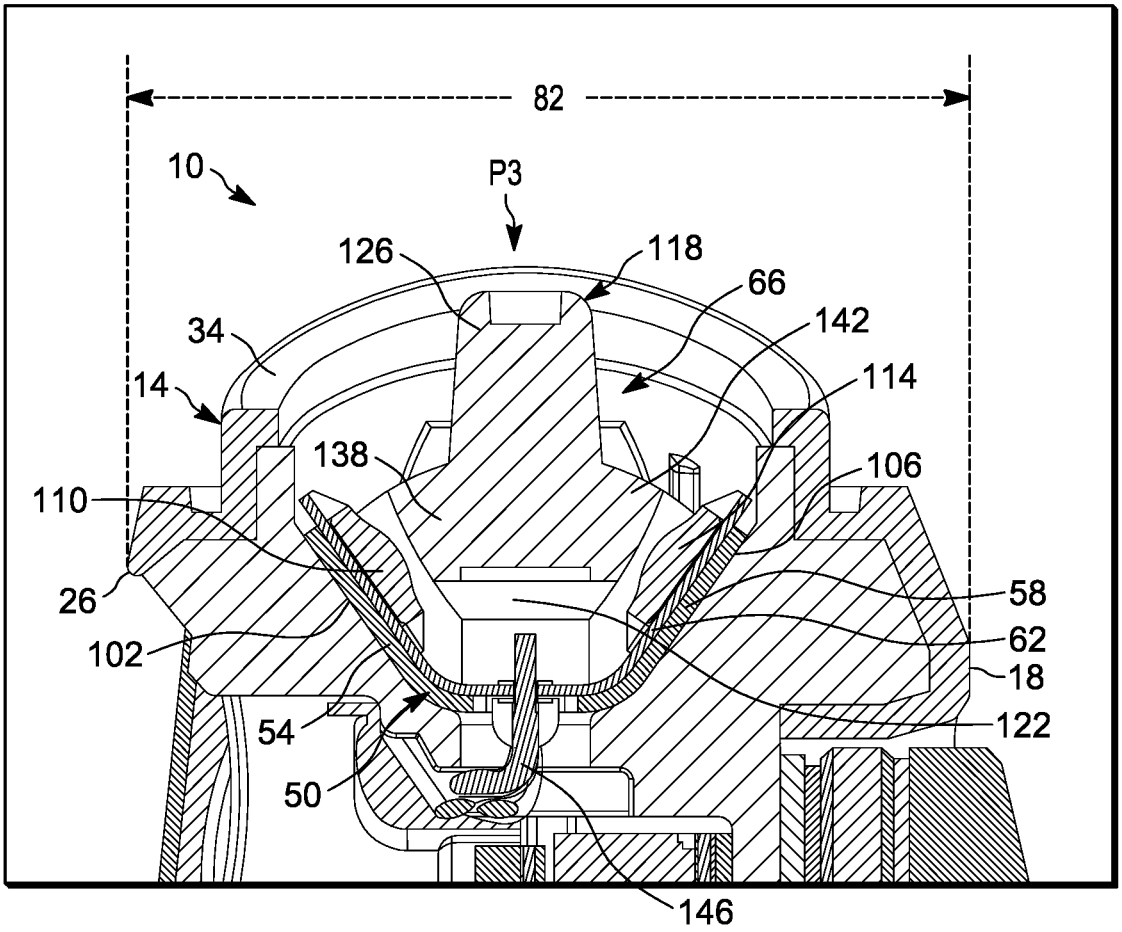
Figure 4:
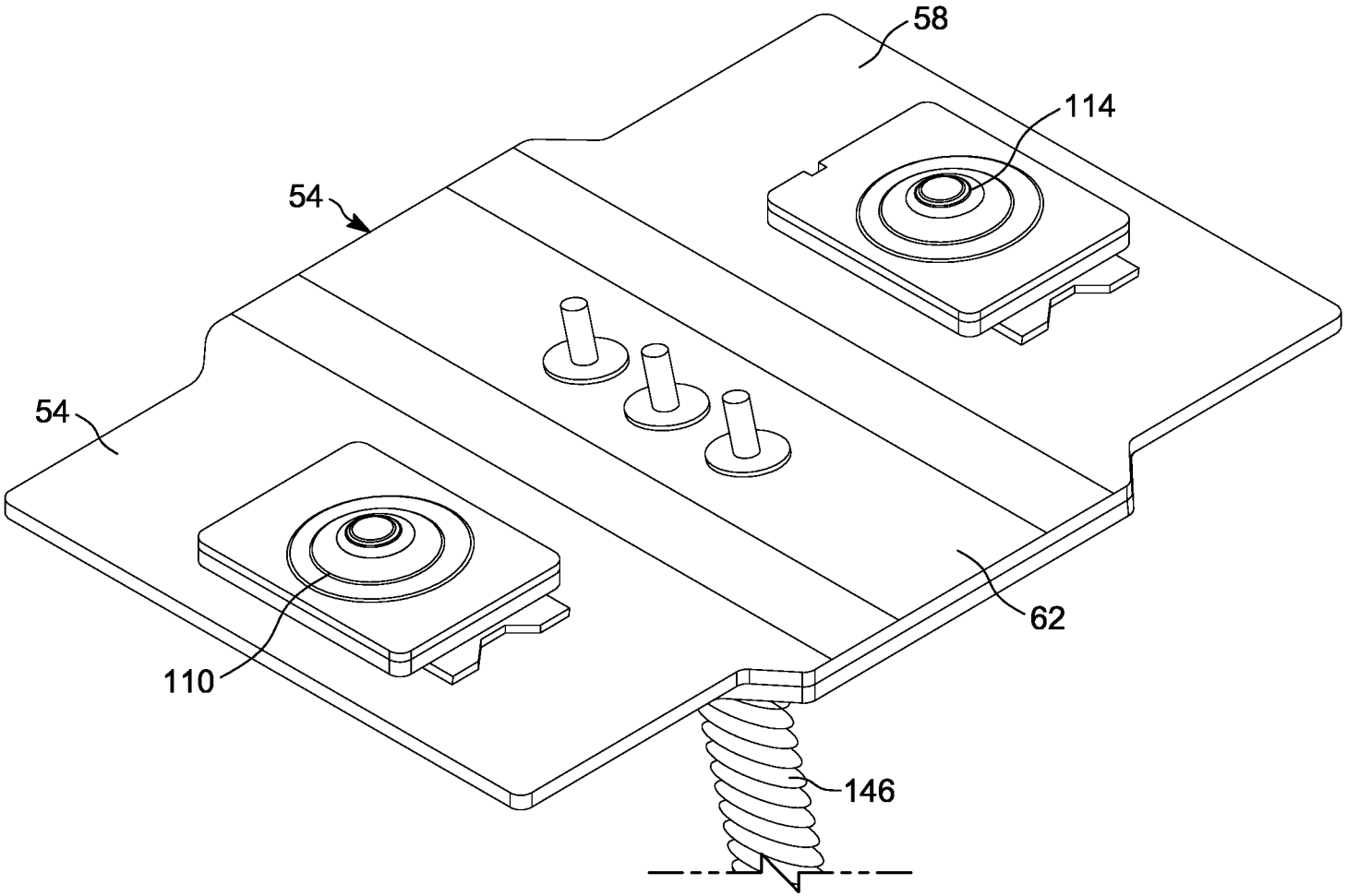
FIG. 4 illustrates a perspective view of a circuit board of the toggle-type switch in the unassembled state.
Figure 5:
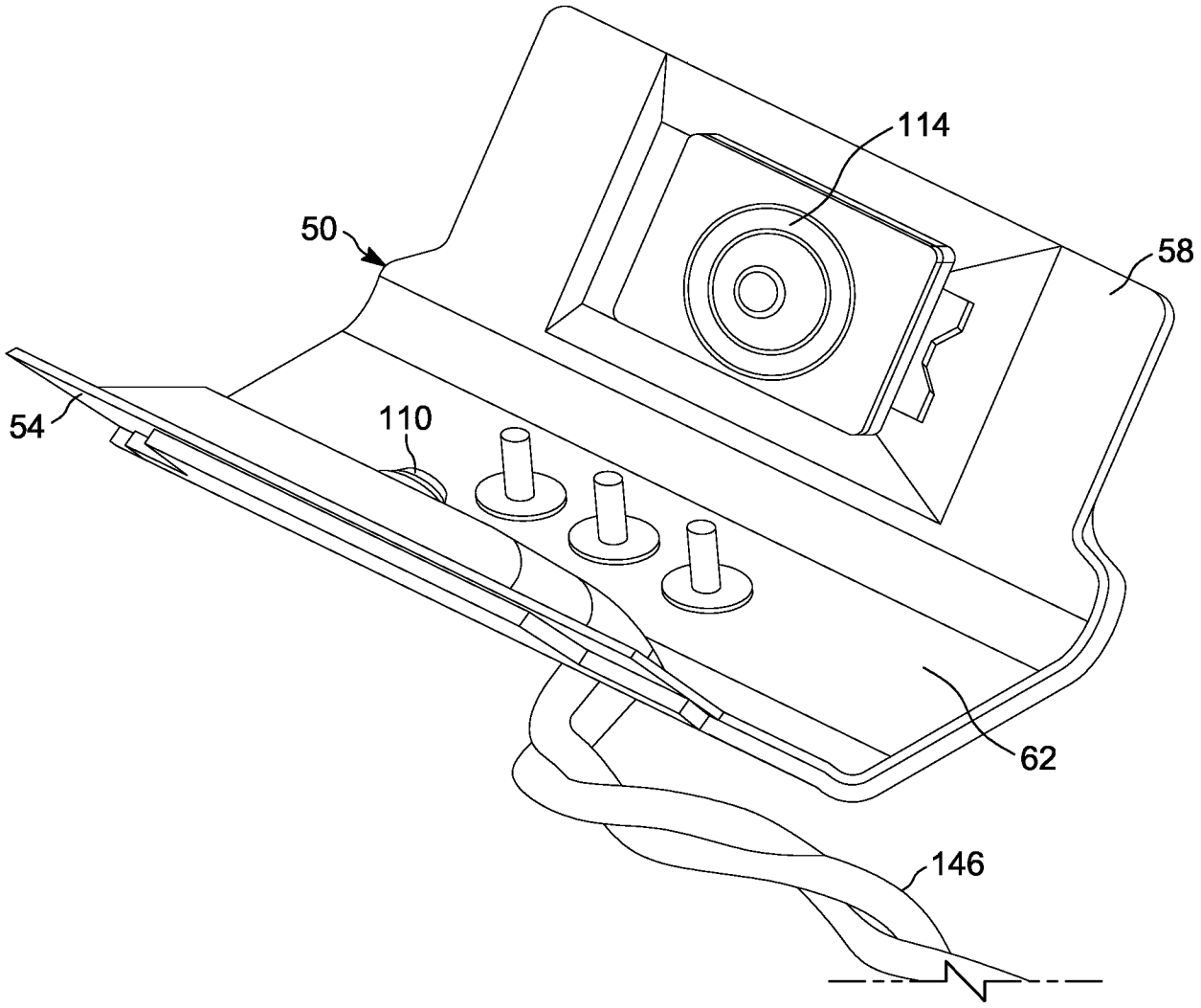
FIG. 5 illustrates a perspective view of the circuit board in the assembled state.
Figure 6:
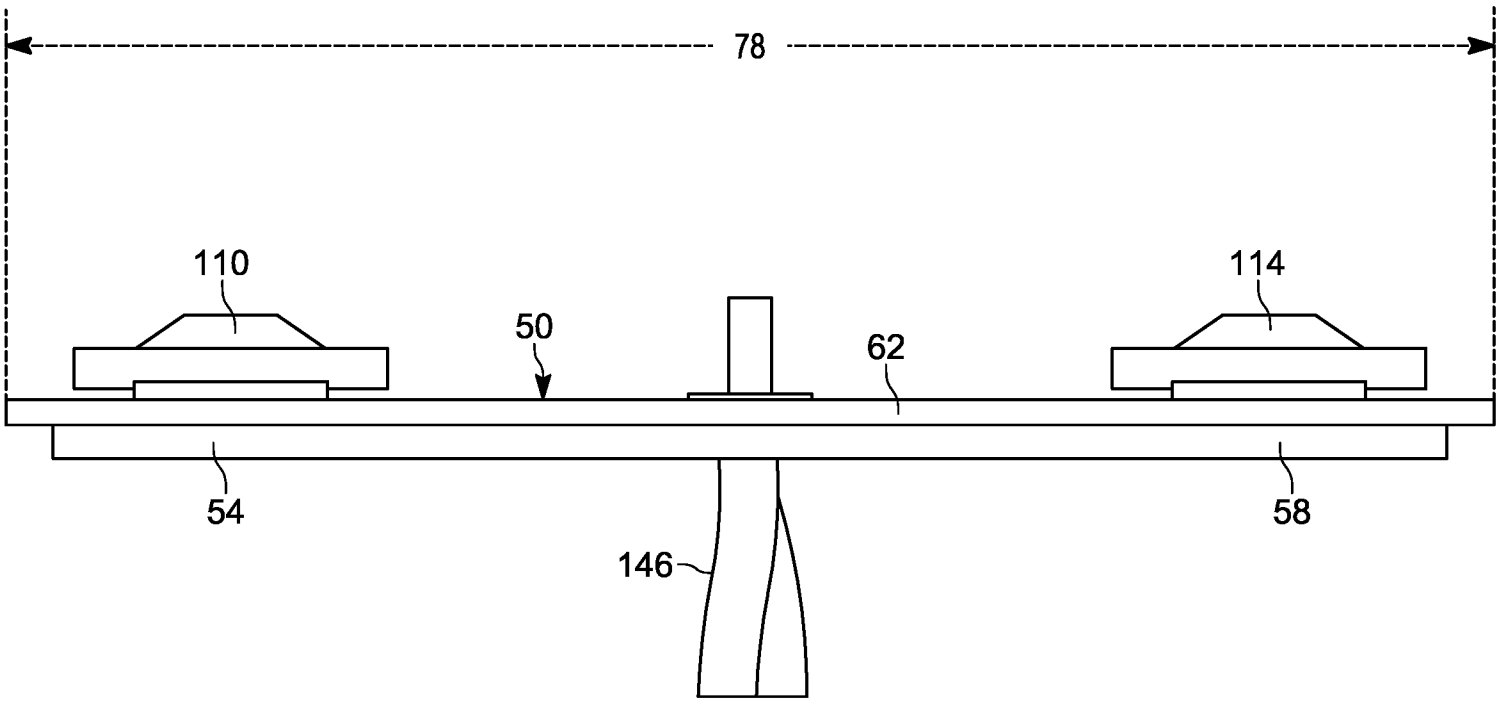
FIG. 6 illustrates a side view of the circuit board in the unassembled state.

With continued reference to FIGS. 2-7, the circuit board 50 may be assembled into a shape to fit into the housing 14, and specifically into a cavity 66 defined by the housing 14. For example, the first flank 54 and the second flank 58 may be bent (for example, upwardly) relative to the central rib 62 and toward one another, such that the first flank 54 and the second flank 58 are offset relative to the central rib 62. FIGS. 2, 4, and 6 illustrate the circuit board 50 in an unassembled state, and FIGS. 3, 5, 7, and 8 illustrate the circuit board 50 in an assembled state. As illustrated in FIGS. 3, 5, 7, and 8, in the assembled state the circuit board 50 has a non-planar shape (for example a C-shape, U-shape, and the like in cross-section). In the example illustrated in FIG. 7, the first flank 54 has been bent upwardly by a first non-zero angle 70, and the second flank 58 has been bent upwardly by a second non-zero angle 74. In the illustrated embodiment, the first angle 70 is approximately 50 degrees. In other embodiments, the first angle 70 is greater than 0 degrees, but less than 90 degrees (for example, between 40 degrees and 60 degrees, or between 30 degrees and 70 degrees). In the example shown, the second angle 74 is, like the first angle 70, also approximately 50 degrees and equal to the first angle 70. In other embodiments, the second angle 74 is a different angle that is greater than 0 degrees but less than 90 degrees (for example between 40 degrees and 60 degrees, or between 30 degrees and 70 degrees). The first angle 70 may also be different than the second angle 74. For example, the first angle 70 may be 50 degrees, and the second angle 74 may be 70 degrees, or the second angle 74 may be 50 degrees, and the first angle 70 may be 70 degrees. In yet other embodiments, the first flank 54 may not be bent at all, and only the second flank 58 is bent, or the second flank 58 may not be bent at all, and only the first flank 54 is bent. In yet other embodiments, the first flank 54 or the second flank 58 may be bent at least 90 degrees (for example 100 degrees) relative to the central rib 62.

Figure 7:
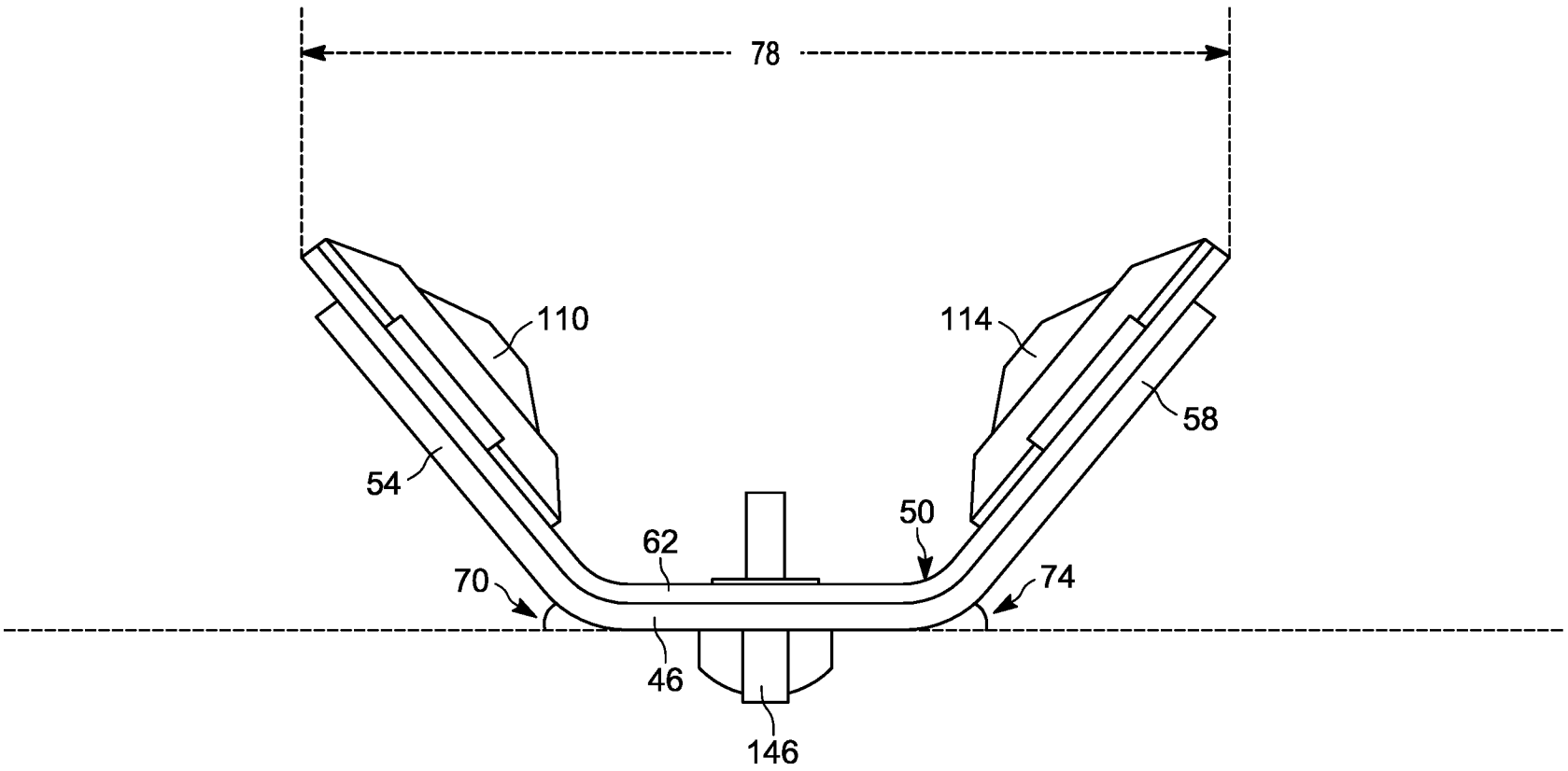
FIG. 7 illustrates a side view of the circuit board in the assembled state.

With reference to FIGS. 6 and 7, by assembling the circuit board 50 to have a non-planar shape and by bending the first and/or second flanks 54, 58, an overall width 78 of the circuit board 50 is reduced. In some embodiments, the width 78 is reduced by at least 10%, at least 20%, at least 30%, at least 40%, or by another value. Additionally, and with reference to FIG. 3C, by assembling the circuit board 50 to have a non-planar shape, and by bending the first and/or second flanks 54, 58, an overall thickness 82 of the housing 14 (as measured from the front portion 18 to the rear portion 26) may also be reduced (for example by at least 10%, at least 20%, at least 30%, or another value) as compared to portable communications devices that do not include the non-planar circuit board 50. Reducing the thickness of the housing 14 may provide for a thinner portable communications device 10.

With reference to FIG. 2, in the illustrated embodiment the cavity 66 is defined by at least one curved surface 86 of the housing 14, a first inclined surface 90 of the housing 14, and a second inclined surface 94 of the housing 14. The first and second inclined surfaces 90, 94 are each planar surfaces that define a non-zero angle 98 therebetween. As illustrated in FIG. 3C, the first flank 54 of the circuit board 50 is coupled (for example pressed and adhered or otherwise attached) to the first inclined surface 90, and the second flank 58 of the circuit board 50 is coupled (for example pressed and adhered or otherwise attached) to the second inclined surface 94. The first flank 54 includes a first planar surface 102 in contact with the first inclined surface 90, and the second flank 58 includes a second planar surface 106 in contact with the second inclined surface 94.

With reference to FIGS. 2-7, the toggle-type switch 46 (for example toggle switch assembly or a switch assembly) further includes a first electrical contact element 110 coupled to the first flank 54, and a second electrical contact element 114 coupled to the second flank 58. In the illustrated embodiment, the first and second electrical contact elements 110, 114 are identical in size and shape, and generally face each other. In other embodiments, the first electrical contact element 110 may have a different size and/or shape than the second electrical contact element 114, and/or may be located at a different location along its respective first flank 54 or second flank 58.

Figure 8:
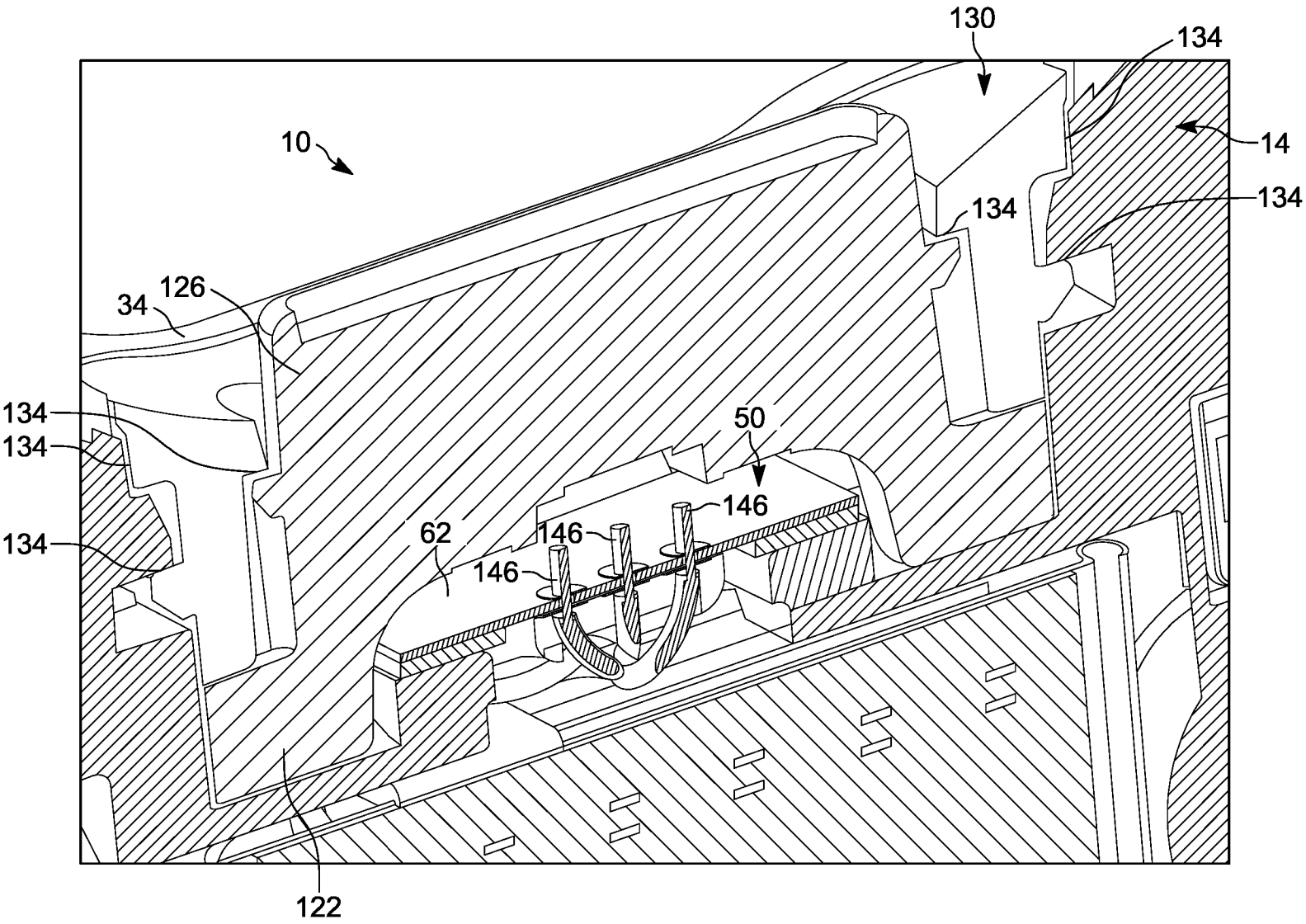
FIG. 8 illustrates a cross-sectional view of the toggle-type switch in the assembled state.

With reference to FIGS. 2, 3, and 8, the toggle-type switch 46 also includes a projecting lever 118 (for example, a toggle element) located above the central rib 62 and between the first flank 54 and the second flank 58. The projecting lever 118 is coupled to the housing 14 and is disposed at least partially within the cavity 66. The projecting lever 118 includes a lower region 122 disposed within the cavity 66, and an upper region 126 (for example, a leg) that is moved or pushed back and forth with a finger or other object so as to pivot the projecting lever 118. With reference to FIG. 8, in the illustrated embodiment a sealing element 130 (for example, made of rubber) is pressed down around the projecting lever 118 into the cavity 66. The sealing element 130 includes sealing surfaces 134 that interact with or otherwise align with surfaces of the housing 14 defining the cavity 66 to constrain the lower region 122 of the projecting lever 118 and to prevent the projecting lever 118 from exiting the cavity 66.

With reference to FIGS. 2 and 3, the projecting lever 118 includes a first leg 138 that engages the first electrical contact element 110 and a second leg 142 that engages the second electrical contact element 114. The upper region 126 acts as a third leg of the projecting lever 118. The projecting lever 118 pivots between a first position P1 (FIG. 3A) and a second position P2 (FIG. 3B). In the first position P1, the first leg 138 is in contact with the first electrical contact element 110 and the second leg 142 is out of contact with the second electrical contact element 114. In the second position P2, the second leg 142 is in contact with the second electrical contact element 114 and the first leg 138 is out of contact with the first electrical contact element 110. In some embodiments, the projecting lever 118 also pivots to a third position P3 (FIG. 3C) where the first leg 138 is out of contact with the first electrical contact element 110 and the second leg 142 is out of contact with the second electrical contact element 114.

With reference to FIG. 8, the circuit board 50 is electrically coupled to one or more components of the portable communications device 10. For example, as illustrated in FIG. 8, the circuit board 50 is coupled to at least one electrical lead 146. The electrical leads 146 (or other electrical connections extending from the circuit board 50) may be electrically coupled to the first and second electrical contact elements 110, 114, as well as to the display 22 to control features (for example, menu items) appearing on the display 22 or to control other features on the portable communications device 10 (for example, volume). Thus, when the projecting lever 118 is moved to the first position, a circuit may be opened or closed on the circuit board 50, and a menu item may be selected or highlighted on the display 22 or the volume may be increased. When the projecting lever 118 is moved to the second position a circuit may again be opened or closed on the circuit board 50, and a different menu item may be selected or highlighted on the display 22 or the volume may be decreased. When the projecting lever 118 is moved to the third position, the menu item previously selected may remain selected, or the volume level previously selected may remain selected. Other embodiments include various other functions for the first, second, and/or third positions.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A toggle-type switch for a portable communications device, the toggle-type switch comprising:

a circuit board configured to be positioned within a cavity defined by a housing of a portable communications device and including a first planar flank, a second planar flank disposed opposite the first flank, and a central rib disposed between the first flank and the second flank, wherein the first flank and the second flank are each angled relative to the central rib at non-zero angles such that circuit board overall has a non-planar shape;

a first electrical contact element coupled to the first flank;

a second electrical contact element coupled to the second flank; and a projecting lever located above the central rib and between the first flank and the second flank and having a first leg configured to engage the first electrical contact element and a second leg configured to engage the second electrical contact element;

wherein the first and second planar flanks are each angled relative to the central rib such that the first planar flank faces the second planar flank.

2. The toggle-type switch of claim 1, wherein the projecting lever is configured to pivot between a first position where the first leg is in contact with the first electrical contact element and the second leg is out of contact with the second electrical contact element, and a second position where the second leg is in contact with the second electrical contact element and the first leg is out of contact with the first electrical contact element.

3. The toggle-type switch of claim 2, wherein the projecting lever is configured to pivot to a third position where the first leg is out of contact with the first electrical contact element and the second leg is out of contact with the second electrical contact element.

4. The toggle-type switch of claim 1, wherein the projecting lever includes a third, elongate, vertically-extending leg configured to be pressed directly by a finger to pivot the projecting lever, and wherein the third leg is disposed above each of the first and second legs.

5. The toggle-type switch of claim 1, wherein the first flank has a rectangular shape, and wherein the second flank has a rectangular shape.

6. The toggle-type switch of claim 5, wherein the central rib has a substantially rectangular shape.

7. The toggle-type switch of claim 1, wherein the first flank and the second flank have substantially identical shapes and sizes.

8. The toggle-type switch of claim 1, wherein the first flank is angled relative to the central rib at a first non-zero angle, and the second flank is angled relative to the central rib at a second non-zero angle.

9. The toggle-type switch of claim 8, wherein the first non-zero angle is equal to the second non-zero angle.

10. The portable communications device of claim 1, wherein the first planar flank is angled relative to the central rib at an angle of between 30 degrees and 70 degrees, and wherein the second planar flank is angled relative to the central rib at an angle of between 30 degrees and 70 degrees.

11. A portable communications device comprising:

a housing having a front portion, a rear portion disposed opposite the front portion, and a side portion that extends between the front portion and the rear portion, wherein the side portion includes a cavity; and a toggle-type switch having a circuit board positioned within the cavity, the circuit board including a first flank, a second flank disposed opposite the first flank, and a central rib disposed between the first flank and the second flank, wherein the circuit board has a non-planar shape, wherein the first flank of the circuit board and the second flank of the circuit board are each offset relative to the central rib of the circuit board, wherein the toggle-type switch further includes a first electrical contact element coupled to the first flank, a second electrical contact element coupled to the second flank, and a projecting lever located above the central rib and between the first flank and the second flank and having a first leg configured to engage the first electrical contact element and a second leg configured to engage the second electrical contact element wherein the cavity is defined by a first inclined surface of the housing and a second inclined surface of the housing, wherein the first and second inclined surfaces of the housing are each planar surfaces that define a non-zero angle therebetween, wherein the first flank of the circuit board is coupled to the first inclined surface of the housing and the second flank of the circuit board is coupled to the second inclined surface of the housing.

12. The portable communications device of claim 11, wherein the first flank of the circuit board includes a first planar surface in contact with the first inclined surface of the housing, and wherein the second flank of the circuit board includes a second planar surface in contact with the second inclined surface of the housing.

13. A portable communications device comprising:

a housing defining an outer casing for the portable communications device;

a flexible circuit board coupled to the housing, wherein the flexible circuit board has a non-linear cross-sectional profile;

a projecting lever operatively coupled to the housing and the flexible circuit board;

a first electrical contact element coupled to an inner surface of the flexible circuit board; and a second electrical contact element coupled to the inner surface of the flexible circuit board, wherein the flexible circuit board has a C-shaped cross-sectional profile, such that the first electrical contact element faces the second electrical contact element, wherein the projecting lever is configured to pivot between the first electrical contact element and the second electrical contact element to perform a switch operation.

14. The portable communications device of claim 13, wherein the projecting lever is configured to pivot between a first position where the projecting lever is in contact with the first electrical contact element and out of contact with the second electrical contact element, and a second position where the projecting lever is in contact with the second electrical contact element and out of contact with the first electrical contact element.

15. The portable communications device of claim 14, wherein the projecting lever is configured to pivot to a third position where the projecting lever is out of contact with both the first electrical contact element and the second electrical contact element.

16. A portable communications device comprising:

a housing defining an outer casing for the portable communications device;

a flexible circuit board coupled to the housing;

a first electrical contact element coupled to the flexible circuit board;

a second electrical contact element coupled to the flexible circuit board; and a projecting lever coupled to the housing, wherein the projecting lever is configured to pivot between a first position where the projecting lever is in contact with the first electrical contact element and out of contact with the second electrical contact element, a second position where the projecting lever is in contact with the second electrical contact element and out of contact with the first electrical contact element, and a third position where the projecting lever is out of contact with both the first electrical contact element and the second electrical contact element;

wherein the flexible circuit board has a C-shaped cross-sectional profile, such that the first electrical contact element faces the second electrical contact element.

17. The portable communications device of claim 16, wherein the housing includes a front portion, a rear portion disposed opposite the front portion, and a side portion that extends between the front portion and the rear portion, wherein the side portion defines a cavity, and wherein the flexible circuit board is coupled to the housing within the cavity.

18. The portable communications device of claim 16, wherein the projecting lever includes a first leg configured to engage the first electrical contact element and a second leg configured to engage the second electrical contact element.

19. The portable communications device of claim 17, wherein the front portion includes a display.

* * * * *